US005776559A

United States Patent [19]

Woolford

[11] Patent Number: 5,776,559

[45] Date of Patent: Jul. 7, 1998

[54] ELECTRIC CHRISTMAS TREE

[76] Inventor: Esther Woolford, 4708 Montebello Ave., Las Vegas, Nev. 89110

[21] Appl. No.: 834,019

[22] Filed: Apr. 11, 1997

[51] Int. Cl.[6] ..... A47G 33/06

[52] U.S. Cl. ..... 428/18; 362/123; 428/20

[58] Field of Search ..... 428/18, 19, 20; 362/123

[56] References Cited

U.S. PATENT DOCUMENTS

| | | | |
|---|---|---|---|
| 3,617,732 | 11/1971 | Fisher | 428/18 X |
| 3,735,117 | 5/1973 | Hunt | 362/123 |
| 4,364,102 | 12/1982 | Huppert et al. | 362/123 |
| 4,858,086 | 8/1989 | Pietrantonio et al. | 362/123 |

*Primary Examiner*—Henry F. Epstein
*Attorney, Agent, or Firm*—Patent & Trademark Services; Joseph H. McGlynn

[57] ABSTRACT

An electrified, artificial Christmas tree, which comprises both the artificial tree, composed of a stand and trunk with attachable branches, and various electrical components. The trunk portion of the tree is composed of a plurality of coupled sections which are joined together in a vertical orientation, and each of which has holes for branches to be inserted. The trunk pieces also have electrical sockets which are internally connected to the base of the trunk. The base of the trunk has attached to it another electrical socket and a master power cable. In use, the tree is assembled as any standard artificial tree, connecting trunk pieces together, and inserting into them branches of various sizes. Any conventional ornament or lighting fixture may be hung on these branches, and plugged into the trunk for power requirements. A stand at the base of the trunk provides stability, and internal circuit breakers provide assurance against fire. A line from the trunk is plugged into a powered electrical to provide power to the entire tree.

6 Claims, 1 Drawing Sheet

ELECTRIC CHRISTMAS TREE

BACKGROUND OF THE INVENTION

This invention relates generally to artificial Christmas trees and, more particularly, to artificial Christmas trees that are equipped with electrical wiring.

DESCRIPTION OF THE PRIOR ART

Numerous inventions relating to electrified artificial trees have been proposed in the prior art. Often, they seek to construct artificial trees which have the capability of carrying a current so as to allow for internal illumination. U.S. Pat. No. 3,617,732 discloses an artificial tree having a support base, a trunk member and a limb member connected to the trunk member. The tree also has an electric light secured to the limb member and electrically connected to power supply means regulated with voltage reduction means connected to the tree's base. The electric light can be directly connected to the trunk member and the tree's base can include means for rotating the trunk member.

U.S. Pat. No. 3,735,117 discloses an artificial Christmas tree having an electrical circuit built into it so to eliminate dangling wiring hanging visibly from the tree branches. The tree includes a trunk supported at its lower end on a tree stand and a series of sidewardly radiating tree branches supporting twigs with needles. The trunk and branches have electrical wiring there leading from a transformer in the tree stand to electric lamp sockets scattered upon the twigs and branches, with the transformer being connected by an extension cord and plug to an electric power source of a house.

U.S. Pat. No. 4,364,102 discloses an internally illuminated optical display. The display comprises a hollow interior containing therein a light source and which can be in the form of a Christmas tree in which the trunk of the tree is hollow and contains a light source connected to an electrical outlet or storage battery. The branches of the tree are inserted into the trunk and include a hollow portion with light emitting holes and/or bulbs.

U.S. Pat. No. 4,858,086 discloses an illuminated decorative display using fiber optics. The displays are in the form of Christmas season ornaments such as wreaths, Christmas trees, and outdoor lighting series. The simulation of light bulbs is achieved by transmitting light through a solid light conducting medium. In the case of the Christmas tree, a cast iron medium in the form of a coniferous branch is used.

Most of the prior art electrical artificial trees have sought to provide lighting as part of the device itself. There remains a need for a device which allows the freedom of displaying and utilizing existing light strands and series on an artificial tree, while still maintaining the aesthetic value and convenience of an electrically wired artificial tree.

SUMMARY OF THE INVENTION

The present invention is an electrified, artificial tree, with a construction of a typical artificial Christmas tree. The invention comprises both the artificial tree, composed of a stand and trunk with attachable branches, and various electrical components. The trunk portion of the tree is composed of a plurality of coupled sections which are joined together in a vertical orientation, and each of which has holes for branches to be inserted. The trunk pieces also have electrical sockets which are internally connected to the base of the trunk. The base of the trunk has attached to it another electrical socket and a master power cable.

In use, the tree is assembled as any standard artificial tree, connecting trunk pieces together, and inserting into them branches of various sizes. Any conventional ornament or lighting fixture may be hung on these branches, and plugged into the trunk for power requirements. A stand at the base of the trunk provides stability, and internal circuit breakers provide assurance against fire. A line from the trunk is plugged into a powered electrical outlet to provide power to the entire tree.

Accordingly, it is an object of this invention to provide an easily assembled artificial tree.

It is a further object of this invention to provide access to electrical power for ornaments hung on the artificial tree.

Finally, it is an object of this invention to locate the access to power near the objects desiring power, that is on the trunk.

DESCRIPTION OF THE PREFERRED EMBODIMENT

Figure 1:
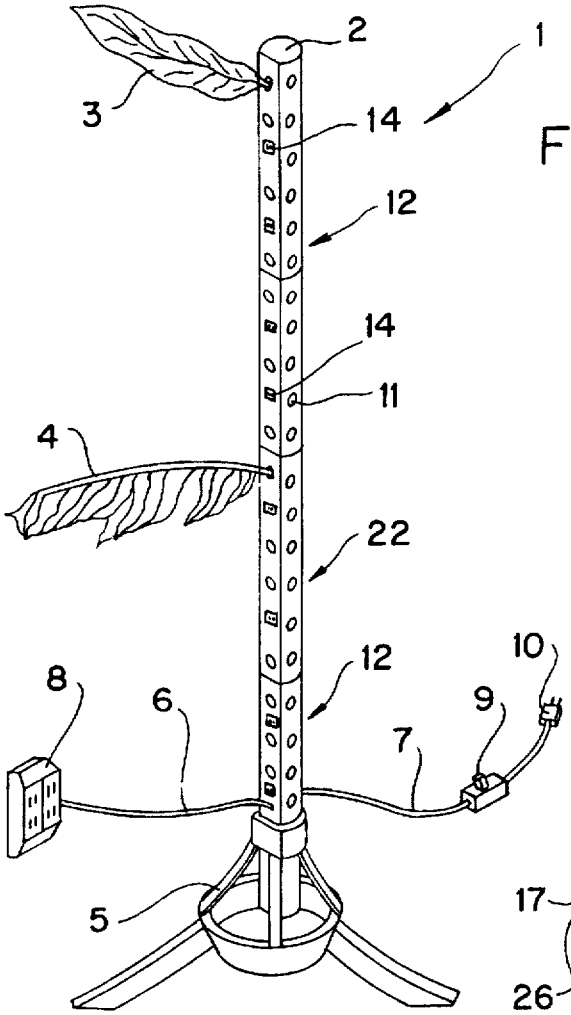
FIG. 1 shows a perspective view of the invention.

Referring now to the drawings, there is shown in FIG. 1 the present invention 1 comprising a trunk 2 of assembled intermediate trunk sections 22 and a pair of end sections 12. The trunk sections 22 and 12 are identical except the end sections 12 do not have electrical connectors 24, 25 at both ends. The end sections 12 only have one connector at one end to engage with a cooperating connector on adjacent intermediate sections 22. Along the trunk sections are found a plurality of artificial branches 3 and artificial tree limbs 4, which are attached to holes 11 in the artificial trunk 2 as in the manner of any conventional artificial tree. At the base of the trunk 2 is a stand 5, which supports the tree 1 in order to hold it erect. Also emanating from holes near the base of the trunk 2 are two electrical wires 6, 7, one of which is connected to a bank of conventional alternating current electrical outlets 8, and one which is connected to an electrical plug 10. Also on the latter wire is a master power switch 9.

Figure 2:
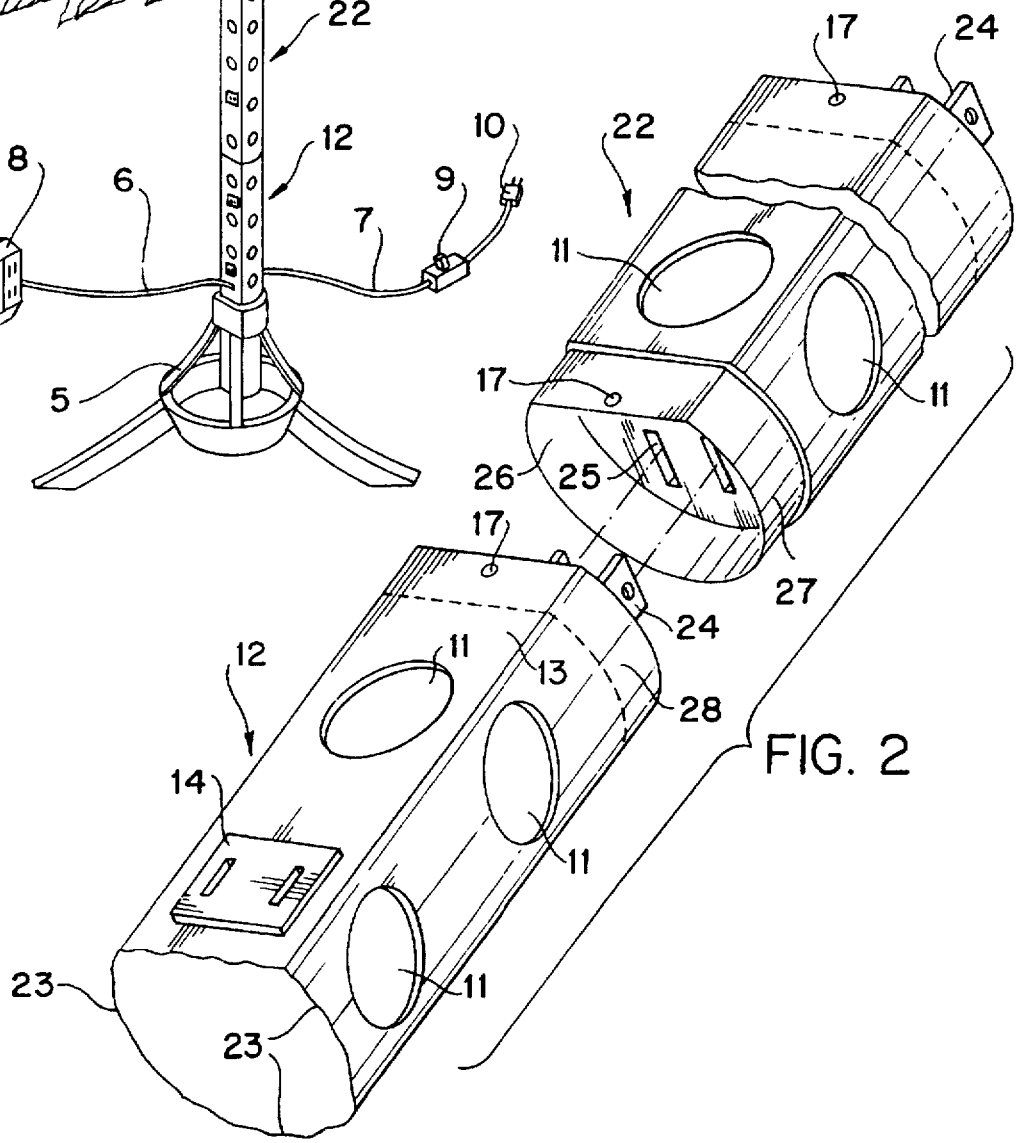
FIG. 2 shows an enlarged view of mating trunk pieces.

FIG. 2 shows an enlarged view of an individual trunk section 12 having one rectangular face 13 and three curved faces 23, thus forming a substantially hollow beam. On each of the faces 13 are holes 11 and one of the faces 13 has at least one electrical socket 14. The remaining faces 13 have a plurality of holes 11.

At one end of the pole section 12 is a conventional electrical plug 24. At the connecting end of the adjoining section 22 is a electrical socket 25 which will receive the plug 24. The socket 25 is recessed into a cavity 26, whereby when the plug is inserted into the socket, the pole sections 12, 22 will hide the plug and socket. Also, it should be noted that even though the socket 25 is shown as recessed, the recess could just as easily be provided on the plug. As long as the electrical connectors are hidden when the pole sections are assembled, either one of the plug or socket could be placed into a recess. Also, the end of the pole section 22 opposite from the socket 25 will be provided with a plug similar to plug 24. In this way the pole sections are connected mechanically. Electrical wires (not shown) run inside the trunk or pole sections 12, 22 and are electrically and mechanically connected to the plug 24 and the sockets 25, 14. Therefore, the plugs 24 and the sockets 25 on adjacent trunk or pole sections 12, 22 can be connected to add additional trunk or pole sections 22 to assemble the tree as shown in FIG. 1.

At each end of the trunk section 12 and section 22 are small holes 17. The holes 17 are of sufficient size to allow a screw (not shown) to pass through, while not so large that the screw's head may fit through the hole 17. In this way the adjacent sections 12, 22 of the tree trunk can be secured together, without relying on the frictional engagement of the plug and socket to hold the tree sections together. Also, the socket 25 is placed within an under cut section 27 (see FIG. 2) which fits within a hollow section or hood 28 formed on the section 12. In this way the adjacent sections 12, 22, when assembled will be secured by the friction fit between the plug and socket 24, 25, the friction fit between the undercut 27 and the hood 28 and the screws extending through the apertures 17 to provide a stable tree trunk.

The description of the trunk pieces 12, 22 given herein is appropriate for a plurality of pieces which are used to construct the body of the trunk 2. However, one piece will lack the recessed material, and another piece will lack screw holes 17, thus allowing one such piece to form the top of the trunk 2, and the other to form the bottom of the trunk 2. By connecting the trunk sections 12, 22 in the manner described herein, the complete trunk 2 is formed.

In use, the tree 1 is constructed in the same manner as any conventional artificial tree, with the trunk 2 being constructed as described above. A plurality of artificial branches 3 and limbs 4, of any conventional shape, are inserted in the holes 11 of the trunk 2, thereby forming an artificial tree. The tree 1 is supported by means of the stand 5 (or any other conventional Christmas tree stand).

Any conventional ornament or lighting fixture may be then hung on the tree 1, and/or the branches 3 and limbs 4, and those objects which require electrical power may be plugged in a conventional manner into the AC electrical sockets 14 found on the trunk sections. The wiring from the electrical sockets 14 is connected, at the base of the trunk 2, by means of any standard electrical connection, to the power line 7 which is then plugged into any powered AC electrical outlet via the plug 10 at the line's end. In this way, power is provided to the entire trunk, and to all objects plugged into sockets 14 in the trunk. Also connected to the master power line 7 by means of any standard electrical connection is the wire 6 connected to the bank of electrical outlets 8. Further power requirements of objects in the vicinity of the tree may be met by connection with the bank of outlets 8. Finally, the master power line 7 can be controlled via a standard electrical switch 9 which can either open or close the circuit to the tree, thereby providing or depriving all objects plugged into the tree and its extensions of power. In this way, the switch 9 acts as a master power switch for the invention.

This invention is composed of many different types of materials, which are best determined by the function of each part of the invention. The trunk 2, branches 3 and limbs 4 are of the materials of any conventional artificial tree, and should be able to withstand the normal loads of tree ornaments. An example would be stamped or punched metal.

Metal stamping and punching is a process which involves a male and female die, both which are machined into the shape of the desired finished product. The dies are made of hardened tool steel, and are placed in the jaws of a hydraulic press. In operation, the steel material to be punched is placed between the two die components and the hydraulic press is activated. The two die quickly "punch out" the desired shape from the sheet metal, producing the desired metal component. The overall rectangular shape of the trunk 2 is accomplished by bending the pre-punched metal to a square form, and crimping the corner ends to form a solid square structure. The holes for the tree limbs and branches, as well as the holes for the A.C. sockets are all formed using this technique. The support mechanism 5 for the trunk 2 may be constructed in a similar fashion.

While metal is proposed as a material for these portions of the invention, it is to be understood that many other materials may be adequate, such as injection molded plastic. Injection molding is a plastic molding procedure whereby heat softened plastic material is forced under very high pressure into a metal cavity mold which is relatively cool. Acceptable metals for the mold are aluminum and steel. The inside cavity of the mold is comprised of two or more halves, and is the same desired shape as the product to be formed. High pressure hydraulics are used to keep the mold components together during the actual injection phase of the molding process. The injected plastic is allowed to cool and harden. The hydraulics holding the multiple component cavity together are released, the halves of the mold are separated and the solid formed plastic item is removed. Injection molding can be a highly automated process and is capable of producing extremely detailed parts at a very cost effective price.

The electrical components discussed herein are to be of any standard materials. Wiring, both internal and external, is to be of standard electrical conductors, such as copper, and may be insulated with any normal insulating material. Electrical sockets 8,14, 25 are to be of conventional construction and are to be U.L. listed. The master power switch 9 is any conventional switch.

Although the electrified artificial tree and the means of using the same according the present invention have been described in the foregoing specification with considerable detail, it is to be understood that modifications may be made to the invention which do not exceed the scope of the appended claims, and modified forms of the present invention done by others skilled in the art to which the invention pertains will be considered infringements of the invention when those modified forms fall within the claimed scope of this invention.

What I claim as my invention is:

1. An artificial Christmas tree comprising:

a plurality of intermediate trunk sections and two end trunk sections, each of said trunk sections having a plurality of tree branch receiving apertures spaced therealong, and a plurality of electrical sockets, each of said intermediate trunk sections having an electrical plug at one end, and an electrical socket at an opposite end, whereby said intermediate trunk sections are mechanically and electrically connected together when said electrical plugs and electrical sockets on said ends of adjacent intermediate trunk sections are joined together, electrical conductor means connected to at least one of said trunk sections at one end and having an electrical plug at another end to connect said artificial Christmas tree to a source of electrical power.

2. The artificial Christmas tree as claimed in claim 1, wherein said trunk sections are planar on one side and rounded on three sides.

3. The artificial Christmas tree as claimed in claim 1, wherein said electrical conductor means has a switch interposed between said trunk sections and said electrical plug.

4. The artificial Christmas tree as claimed in claim 1, wherein a second electrical conductor means is connected to at least one of said trunk sections and has a plurality of electrical sockets connected at an end of said second electrical conductor means.

5. The artificial Christmas tree as claimed in claim 1, wherein one of said electrical plugs and said electrical sockets mounted on said ends of said intermediated trunk sections is mounted within an undercut section, said undercut section engaging a hood portion on an adjacent intermediated trunk section when said intermediated trunk sections are joined together.

6. The artificial Christmas tree as claimed in claim 5, wherein said hood and said undercut have cooperating aperture means for receiving a fastener for holding said trunk sections together.

* * * * *